US010965073B1

(12) United States Patent
Lin

(10) Patent No.: US 10,965,073 B1
(45) Date of Patent: Mar. 30, 2021

(54) MULTIDIRECTIONAL SOCKET STRUCTURE

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 16/826,583

(22) Filed: Mar. 23, 2020

(51) Int. Cl.

| | |
|---|---|
| ***H01R 27/02*** | (2006.01) |
| ***H01R 13/66*** | (2006.01) |
| *H01R 31/02* | (2006.01) |
| *H01R 13/72* | (2006.01) |
| *H01R 25/00* | (2006.01) |
| *H01R 9/24* | (2006.01) |
| *H01R 13/514* | (2006.01) |

(52) U.S. Cl.
CPC ..... *H01R 27/02* (2013.01); *H01R 13/6675* (2013.01); *H01R 9/2408* (2013.01); *H01R 13/514* (2013.01); *H01R 13/72* (2013.01); *H01R 25/003* (2013.01); *H01R 31/02* (2013.01)

(58) Field of Classification Search
CPC ..... H01R 27/02; H01R 25/003; H01R 13/72; H01R 13/514; H01R 9/2408; H01R 31/02; H01R 13/6675
See application file for complete search history.

(56) References Cited

U.S. PATENT DOCUMENTS

| | | | | |
|---|---|---|---|---|
| 5,888,105 | A * | 3/1999 | Brown | H01R 31/02 439/650 |
| 6,135,820 | A * | 10/2000 | Chiang | H01R 13/4534 439/654 |
| 6,443,772 | B1 * | 9/2002 | Chen | H01R 25/003 200/51.02 |
| 7,371,122 | B2 * | 5/2008 | Ivanova | H01R 9/2408 439/652 |
| 7,497,740 | B2 * | 3/2009 | Mei | H01R 13/514 200/51 R |
| 10,367,317 | B1 * | 7/2019 | Rahner | H01R 13/506 |
| 2013/0078861 | A1 * | 3/2013 | Cheng | H01R 25/003 439/620.02 |
| 2013/0171866 | A1 * | 7/2013 | Tracey | H01R 13/56 439/501 |
| 2015/0207271 | A1 * | 7/2015 | Si | H01R 31/02 439/92 |

* cited by examiner

*Primary Examiner* — Tho D Ta
(74) *Attorney, Agent, or Firm* — Wpat, PC

(57) ABSTRACT

A multidirectional socket structure is disclosed, comprising an outer case, an armature part, an electric power line and an outer cladding part enveloping the outer case, wherein the outer case includes plural socket panels facing different directions, and the armature part includes a base body and three electrode boards, in which the base body has a crossbar and sidebars bent and extended from both sides of the crossbar, and the sidebars can further extend a positioning pillar body used to be positioned on the outer case, and the armature part can be provided with different channels along the crossbar and the sidebars for accommodating different electrode boards, such that modular designs can be applied between the outer case and the armature part in order to facilitate more convenient assemblage, thereby effectively reducing manufacturing costs and labor costs.

8 Claims, 10 Drawing Sheets

MULTIDIRECTIONAL SOCKET STRUCTURE

BACKGROUND OF THE INVENTION

1. Field of the Invention

The present invention generally relates to a multidirectional socket structure; in particular, it relates to a multidirectional socket structure featuring modular designs so as to facilitate more compact and convenient assemblage thus effectively reducing manufacturing costs and labor costs.

2. Description of Related Art

At present, sockets and plugs are commonly applied to connect the power supply of various electrical appliances. Due to the increasing number of electrical appliances, the use of sockets and plugs is more frequent and comprehensive, and the industry also continuously improve the sockets and plugs in order to provide better functions.

It is appreciated that multidirectional sockets are designed to be used in all directions, and most of such multidirectional sockets have two electrode parts and a grounding part, in which two sides and front ends of the electrode parts form sockets, and the electrode parts and grounding part are further stacked in groups and respectively connected to the power line and the ground line so as to form the multidirectional sockets.

However, in order to design it as a multidirectional socket, it may be required to connect a significant amount of conductive wires so as to be able to use it with different output sockets. That is, more conductive wires need to be welded therein, so more labor costs are required as well. Therefore, a lot of costs and relevant expenditures may be reduced if this problem can be effectively solved.

Additionally, see that the socket output is multidirectional, a special structure is required for the electrode part. For example, suppose a ∩-shaped structure is to be utilized, as shown in FIG. 1, generally an electrode plate body 1 will be directly installed and unnecessary sections 11 will be machined and removed; however, this process may cause quite a lot of waste materials, so it may inevitably increase its manufacturing costs.

As a result, it is desirable to apply modular designs and conjunctively the bending process of the electrode plate body in order to effectively address the aforementioned issues and successfully reduce the labor costs and material costs. Therefore, the present invention should be an optimal solution to achieve such objectives.

SUMMARY OF THE INVENTION

The multidirectional socket structure according to the present invention comprises: an outer case, including two or more socket panels, in which each socket panel faces different directions and has three insertion holes, and the inside of the outer case has more than one positioning slot; an armature part, installed within the outer case and including: a base body, having a crossbar and sidebars bent and extended from both sides of the crossbar, in which one of the sidebars or two sidebars can further extend downwardly a positioning pillar body for inserting into the positioning slot of the outer case, and the armature part can be provided with a live wire channel, a central wire channel and an earth wire channel along the crossbar and the sidebars, and the live wire channel and the central wire channel are adjacent to the two sides of the earth wire channel, with each side of the earth wire channel, the live wire channel and the central wire channel respectively having a slot hole; a live wire electrode board, installed on the base body, in which the live wire electrode board is configured to extend along the shape of the live wire channel, and a first positioning part is formed on the live wire electrode board at the slot hole adjacent to the live wire channel; a central wire electrode board, installed on the base body, in which the central wire electrode board is configured to extend along the shape of the central wire channel, and a second positioning part is formed on the central wire electrode board at the slot hole adjacent to the central wire channel; an earth wire electrode board, installed on the base body, in which the earth wire electrode board is configured to extend along the shape of the earth wire channel, and a third positioning part is formed on the earth wire electrode board at the slot hole adjacent to the earth wire channel; an electric power line, connected to the outer case, in which the inside of the electric power line includes a live wire electrically connected to the live wire conductive strip, a neutral wire electrically connected to the central wire conductive strip, and a ground wire electrically connected to the earth wire conductive strip; and an outer cladding part which envelops the outer case and simply exposes the socket panels.

More specifically, the three sockets on the socket panel can be communicative respectively with the first positioning part, the second positioning part and the third positioning part thereby allowing the individual front ends of the three power terminals on an externally inserted electric power plug to penetrate the three insertion holes of the socket panel, and then to be pushed forward in order to contact the first positioning part, the second positioning part and the third positioning part for conducting electric power.

More specifically, the first positioning part is formed by two or more parallel plate bodies so as to be able to fixedly locate the plug terminal inserted from the outside.

More specifically, the second positioning part is formed by two or more parallel plate bodies so as to be able to fixedly locate the plug terminal inserted from the outside.

More specifically, the third positioning part is formed by two relatively tilted plate bodies so as to be able to fixedly locate the plug terminal inserted from the outside.

More specifically, the outer case is a cubic structure and has a placement surface which is a plane.

More specifically, the outer case further includes a USB panel which has one or more insertion holes, and the inside of the outer case has a power conversion circuit board which is electrically connected to the live wire, the neutral wire and the ground wire of the electric power line and is installed with one or more USB connectors that communicate with the insertion holes on the USB panel.

More specifically, the aforementioned multidirectional socket structure further comprises an outer cladding part which envelops the outer case and facilitates a more compact assemblage of the outer case.

DETAILED DESCRIPTION OF THE PREFERRED EMBODIMENTS

Figure 1:
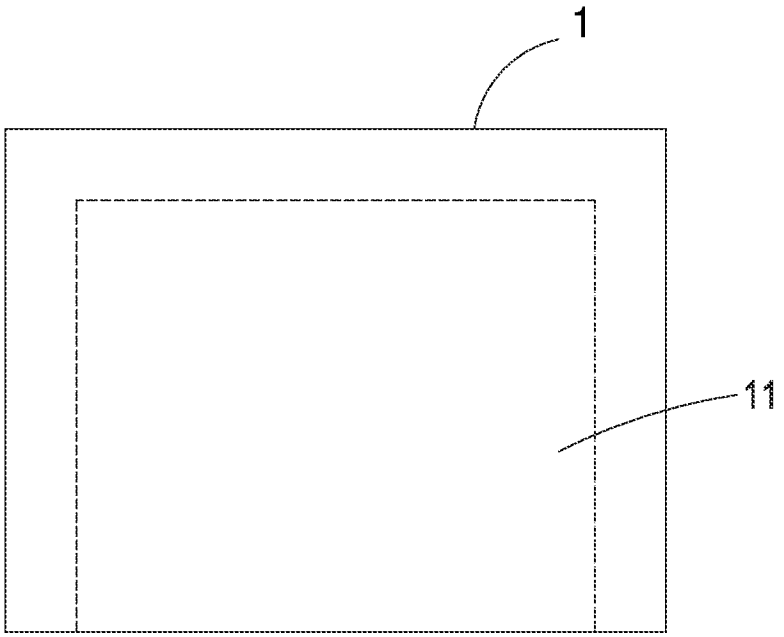
Prior Art FIG. 1
FIG. 1 shows a structural view of a conventional extension socket.
Figure 2:
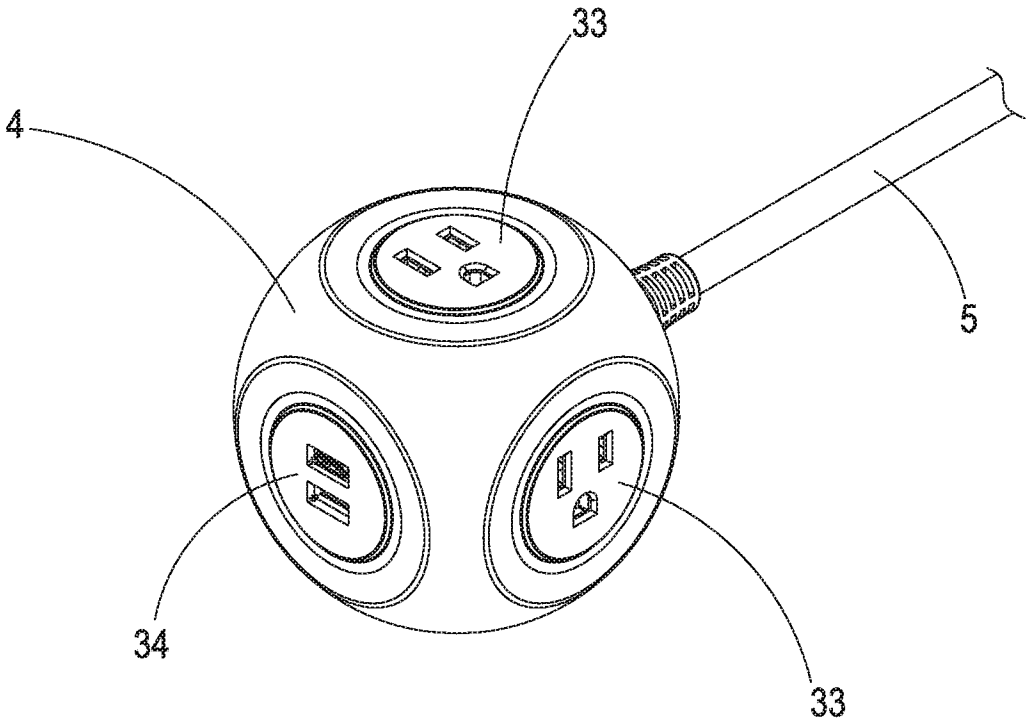
FIG. 2 shows a structural cross-section view of the multidirectional socket structure according to the present invention.
Figure 3:
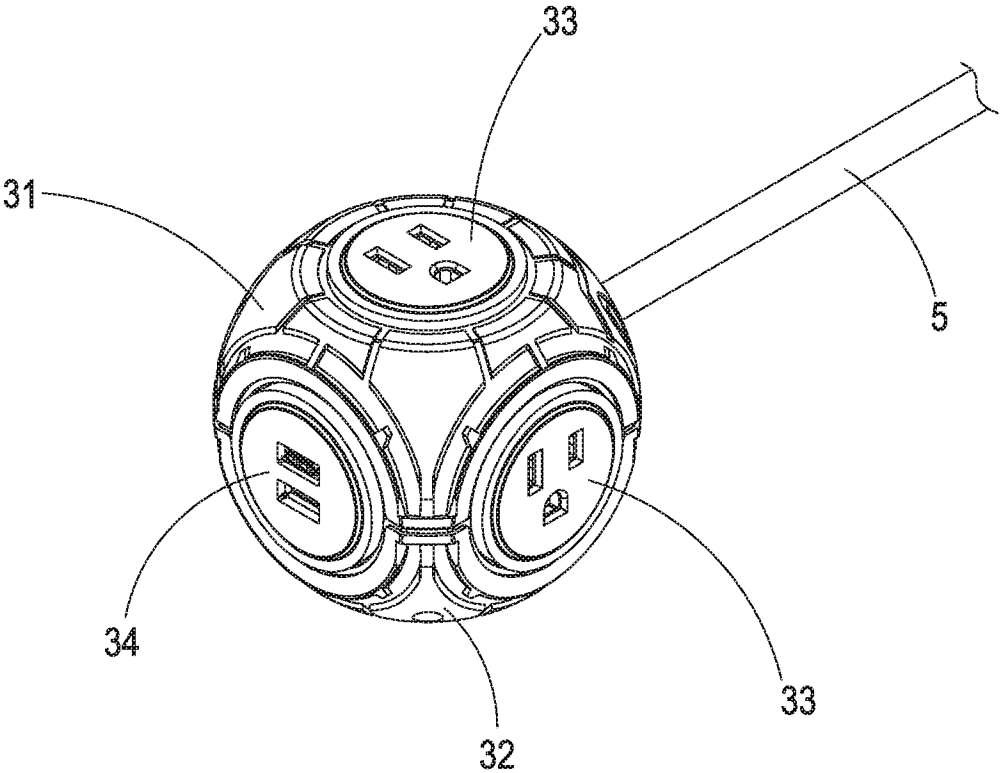
FIG. 3 shows an internal structural view of the multidirectional socket structure according to the present invention.
Figure 4A:
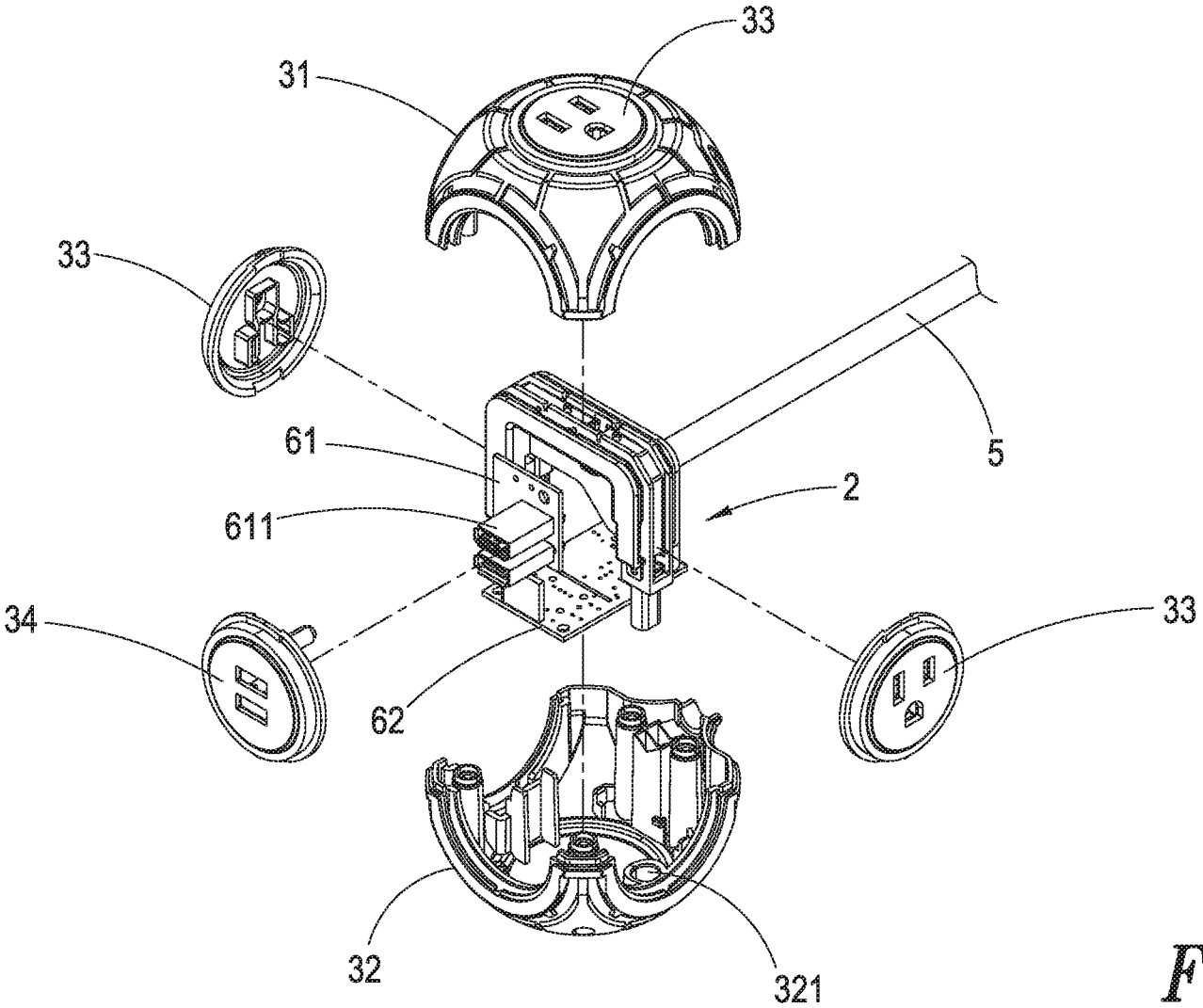
FIG. 4A shows an internal structural disassembled view of the multidirectional socket structure according to the present invention.
Figure 4B:
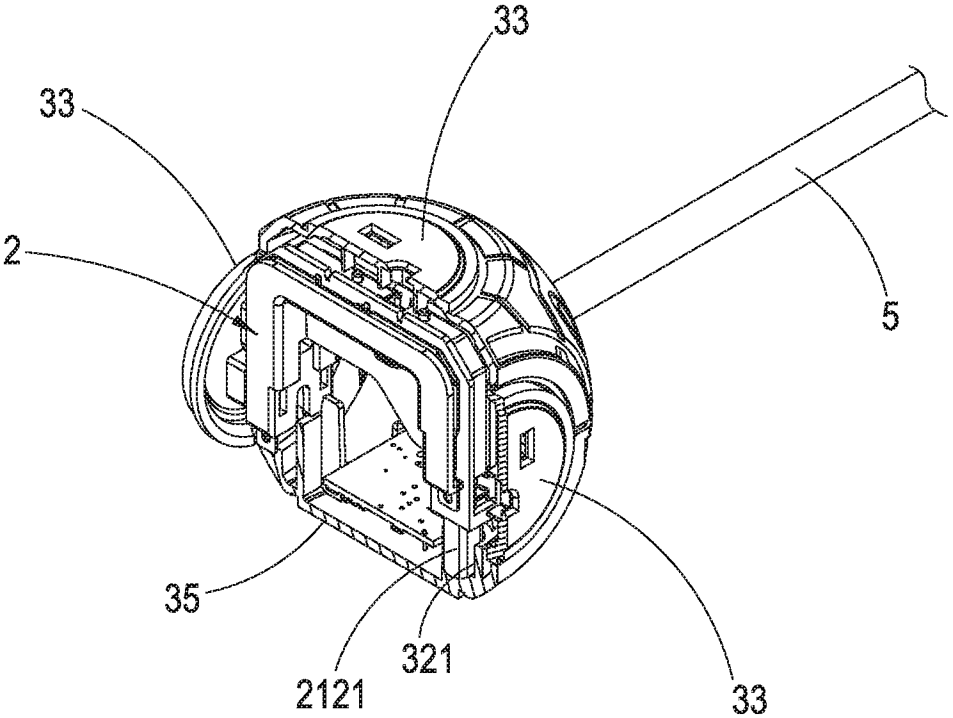
FIG. 4B shows an internal structural cross-sectioned view of the multidirectional socket structure according to the present invention.

Other technical contents, aspects and effects in relation to the present invention can be clearly appreciated through the detailed descriptions concerning the preferred embodiments of the present invention in conjunction with the appended drawings.

As shown in FIGS. 2, 3, 4A and 4B, it can be seen that the multidirectional socket structure according to the present invention comprises an armature part 2, an outer case 3, an outer cladding part 4 and an electric power line 5. Herein the armature part 2 is positioned inside the outer case, and the outer cladding part 4 envelops the outer case (in the present embodiment, the outer cladding part 4 is applied to make the assemblage of the outer case more compact, but in practice the outer cladding part 4 may be optional), and only the socket panel 33 and the USB panel 34 are exposed, wherein the socket panel 33 and the USB panel 34 are facing in different directions, and the socket panel 33 includes three sockets.

Besides, the outer case includes an upper case 31, a lower case 32, a socket panel 33 and a USB panel 34 (the socket panel 33 and the USB panel 34 are snap engaged between the upper case 31 and the lower case 32 to facilitate convenient assembly and disassembly processes), and the inside of the lower case 32 has one or more positioning slot 321. Also, in the present embodiment, the case is a cube and different facing directions of the surfaces thereof are described as below:

(1) a front surface including a USB panel 34;

(2) a left surface including a socket panel 33;

(3) a right surface including a socket panel 33;

(4) an upper surface including a socket panel 33;

(5) a lower surface including a planar placement surface 35;

(6) a rear surface, which includes an electric power line 5, wherein the inside of the electric power line 5 has a live wire electrically connected to the live wire conductive strip 221, a neutral wire electrically connected to the central wire conductive strip 231, and a ground wire electrically connected to the earth wire conductive strip 241.

The lower case 32 can be further internally provided with a power conversion circuit board 61 and a protection circuit board 62. Herein the power conversion circuit board 61 and the protection circuit board 62 are electrically connected to the live, neutral and ground wires of the electric power line 5, and the power conversion circuit board 61 has one or more USB connector 611 connected with the socket on the USB panel 34.

Figure 5A:
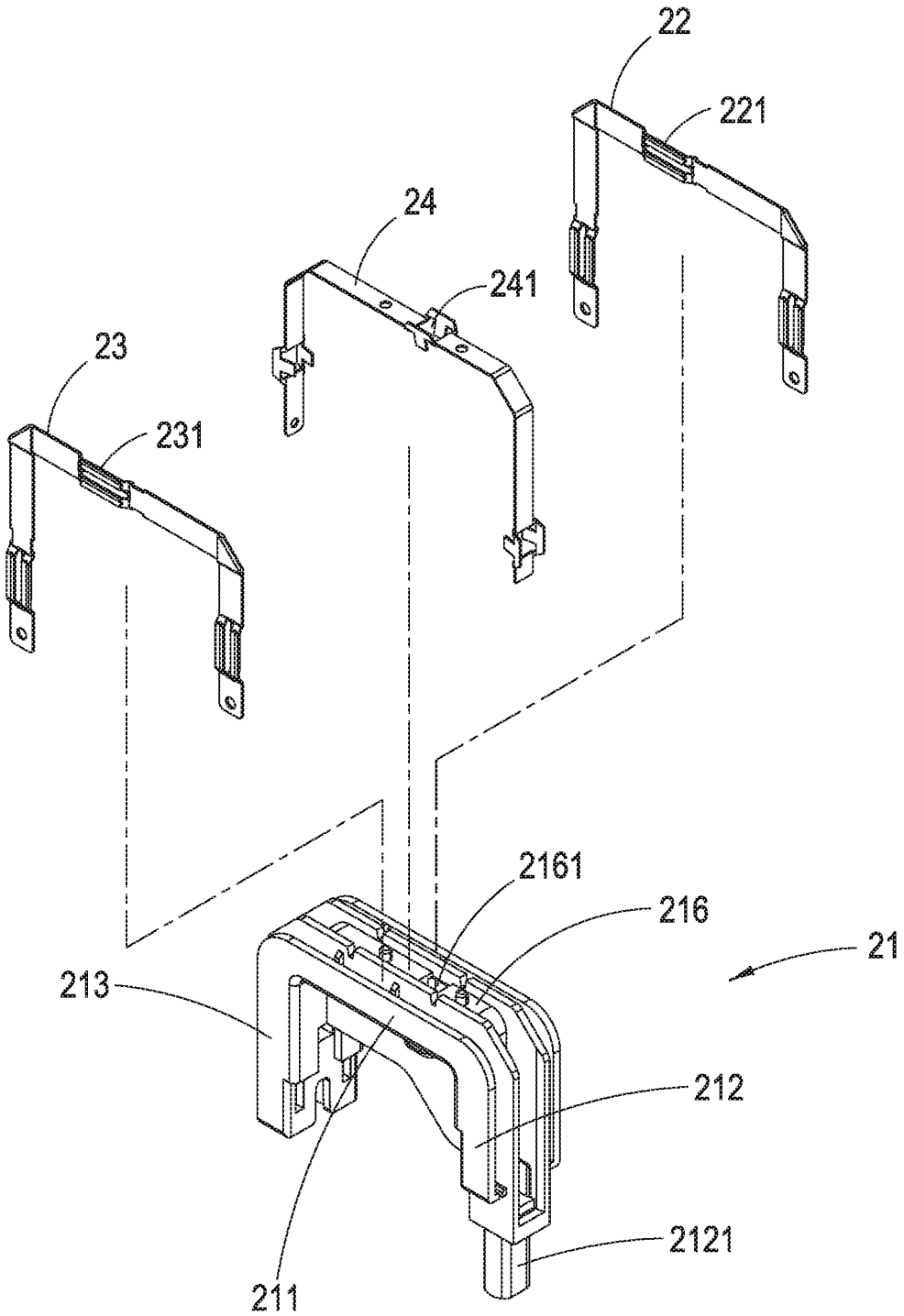
FIG. 5A shows a disassembled stereo view of the armature part in the multidirectional socket structure according to the present invention.
Figure 5B:
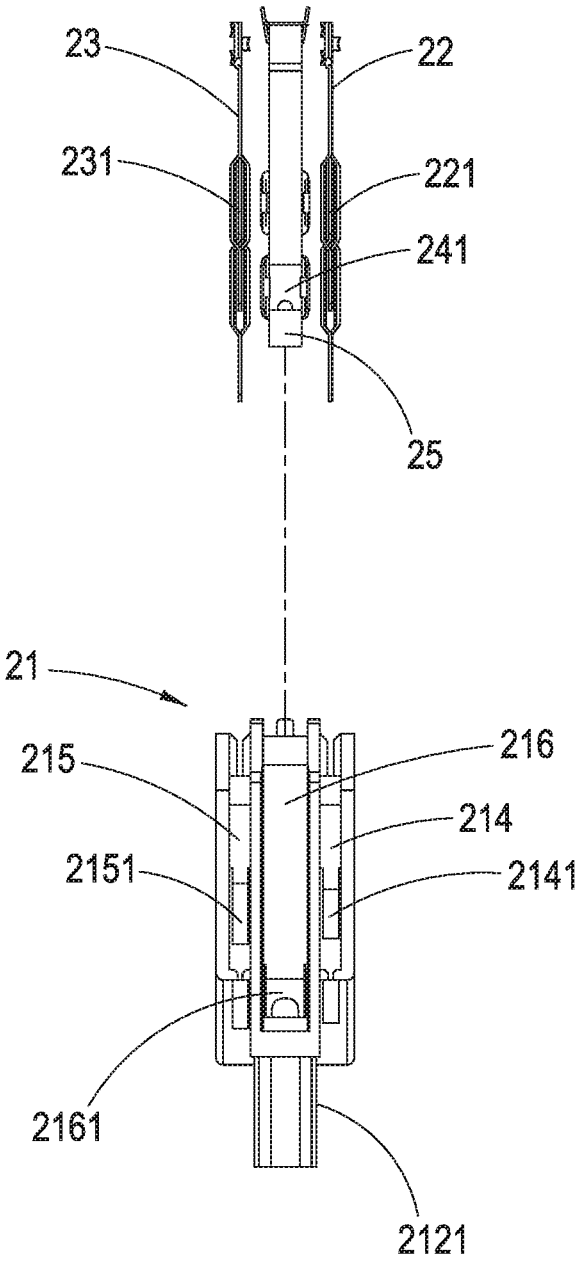
FIG. 5B shows a disassembled planar view of the armature part in the multidirectional socket structure according to the present invention.
Figure 5C:
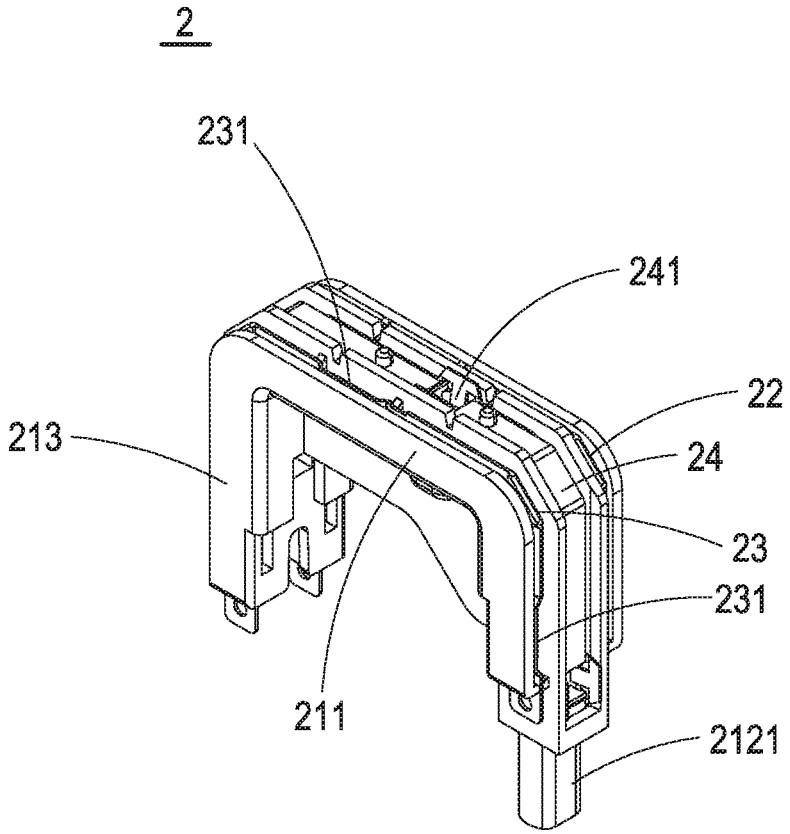
FIG. 5C shows an assembled view of the armature part in the multidirectional socket structure according to the present invention.

Moreover, as shown in FIGS. 5A-5C, the armature part 2 comprises:

(1) a base body 21, having a crossbar 211 and sidebars 212, 213 bent and extended from both sides of the crossbar 211 (it should be noticed that there exist an angle difference between the crossbar 211 and the sidebars 212, 213, and this angle difference is less than 180 degrees), in which the sidebar 212 further extends downwardly a positioning pillar body 2121 for inserting into the positioning slot 321 of the outer case, and the armature part 2 can be provided with a live wire channel 214, a central wire channel 215 and an earth wire channel 216 along the crossbar 211 and the sidebars 212, 213, and the live wire channel 214 and the central wire channel 215 are adjacent to the two sides of the earth wire channel 216, with each side of the earth wire channel 214, the live wire channel 215 and the central wire channel 216 respectively having a slot hole 2141, 2151 and 2161;

(2) a live wire electrode board 22, positioned on the base body 21, wherein multiple conductive strips extend from the live wire electrode board 22 along the shape of the live wire channel 214, and a first positioning part 221 is formed on the conductive strip adjacent to the slot hole 2141 of the live wire channel 214, in which the first positioning part 221 is formed by two or more parallel adjacent plates so as to be able to fixedly locate the plug terminal inserted from the outside;

(3) a central wire electrode board 23, positioned on the base body 21, wherein multiple conductive strips extend from the central wire electrode board 23 along the shape of the central wire channel 215, and a second positioning part 231 is formed on the conductive strip adjacent to the slot hole 2151 of the central wire channel 215, in which the second positioning part 231 is formed by two or more parallel adjacent plates so as to be able to fixedly locate the plug terminal inserted from the outside;

(4) an earth wire electrode board 24, positioned on the base body 21, wherein multiple conductive strips extend from the earth wire electrode board 24 along the shape of the earth wire channel 216, and a third positioning part 241 is formed on the conductive strip adjacent to the slot hole 2161 of the earth wire channel 216, in which the third positioning part 241 is formed by two relatively tilted plates so as to be able to fixedly locate the plug terminal inserted from the outside.

Figure 6:
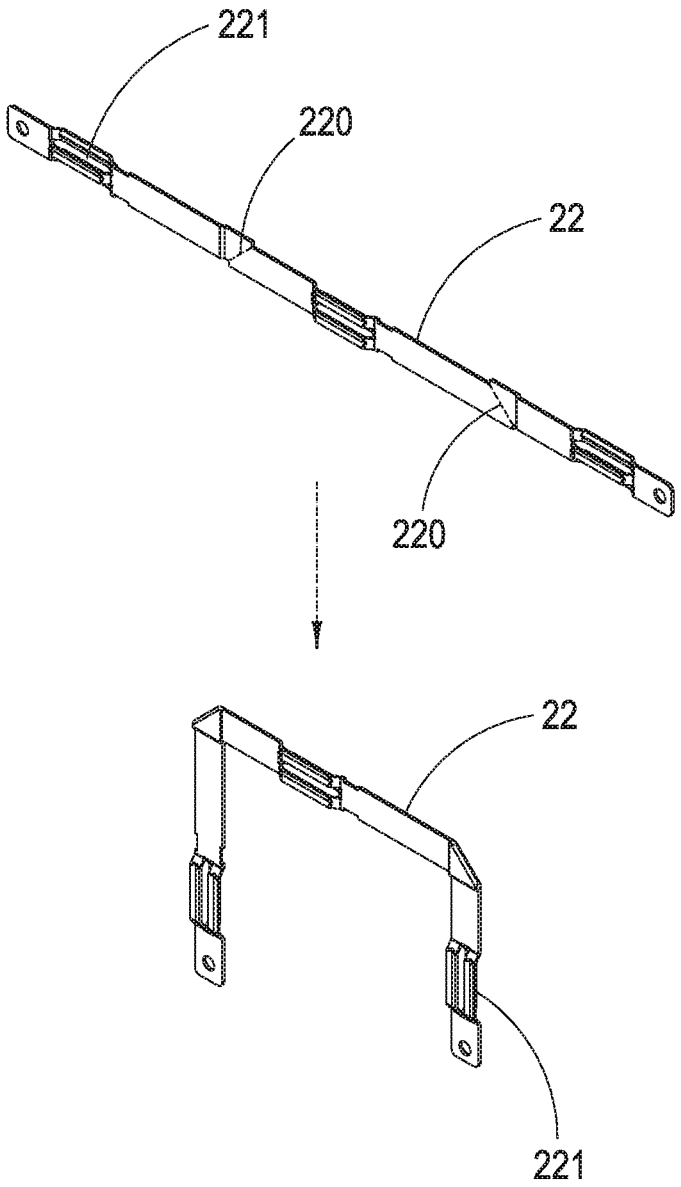
FIG. 6 shows an embodiment view for electrode boards bending in the multidirectional socket structure according to the present invention.

Furthermore, as shown in FIG. 6, taking the live wire electrode board 22 as an example, a straight electrode board can be applied, and then the live wire electrode board 22 is bent into three segments of conductive strips in accordance with the bending line 220, such that an angle difference between two conductive strips is created and less than 180 degrees (similar implementations are done to the central wire electrode board 23 and the earth wire electrode board 24, so the descriptions thereof are omitted for brevity).

Figure 7:
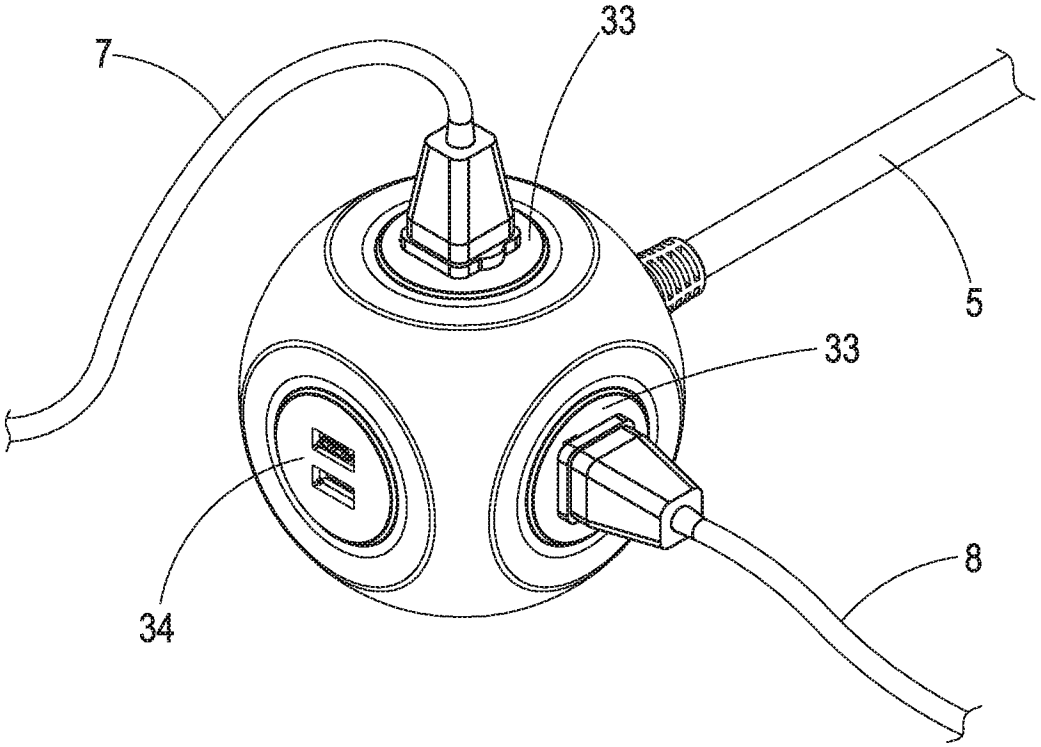
FIG. 7 shows an embodiment view in use of the multidirectional socket structure according to the present invention.

Subsequently, as shown in FIG. 7, it is possible to insert two external power plugs 7, 8 respectively into different socket panels 33. Since the three insertion holes on the socket panel 33 are respectively communicative with the first positioning part 221, the second positioning part 231 and the third positioning part 241 (it should be noticed that, although they are communicative, such first positioning part 221, second positioning part 231 and third positioning part 241 do not extend into the three insertion holes on the socket panel 33), thereby allowing the front ends of the three power terminals on the externally inserted electric power plug to respectively penetrate the three insertion holes on the socket panels 33, then to be pushed forward to contact the first positioning part 221, the second positioning part 231 and the third positioning part 241 in order to conduct electricity.

In comparison with other conventional technologies, the multidirectional socket structure according to the present invention provides the following advantages:

(1) The present invention applies modular designs and conjunctively the bending process of the electrode boards to effectively solve the assembly complexity and further reduce waste materials thus lessening relevant labor costs and material costs.

(2) The multidirectional socket structure according to the present invention provides sockets facing in multiple directions, so sockets in different directions can be utilized based on user's demands.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alterations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A multidirectional socket structure, comprising:

an outer case, including two or more socket panels, in which each socket panel faces different directions and has three insertion holes, and the inside of the outer case has more than one positioning slot; and an armature part, installed within the outer case and including:

a base body, having a crossbar and sidebars bent and extended from both sides of the crossbar, in which one of the sidebars or two sidebars can further extend downwardly to form a positioning pillar body for inserting into the positioning slot of the outer case, and the armature part can be provided with a live wire channel, a central wire channel and an earth wire channel along the crossbar and the sidebars, and the live wire channel and the central wire channel are adjacent to the two sides of the earth wire channel, with each side of the earth wire channel, the live wire channel and the central wire channel respectively having a slot hole;

a live wire electrode board, installed on the base body, in which the live wire electrode board is configured to extend along the shape of the live wire channel, and a first positioning part is formed on the live wire electrode board at the slot hole adjacent to the live wire channel;

a central wire electrode board, installed on the base body, in which the central wire electrode board is configured to extend along the shape of the central wire channel, and a second positioning part is formed on the central wire electrode board at the slot hole adjacent to the central wire channel;

an earth wire electrode board, installed on the base body, in which the earth wire electrode board is configured to extend along the shape of the earth wire channel, and a third positioning part is formed on the earth wire electrode board at the slot hole adjacent to the earth wire channel; and an electric power line, connected to the outer case, in which the inside of the electric power line includes a live wire electrically connected to a live wire conductive strip, a neutral wire electrically connected to a central wire conductive strip, and a ground wire electrically connected to an earth wire conductive strip.

2. The multidirectional socket structure according to claim 1, wherein three sockets on the socket panel can be communicative respectively with the first positioning part, the second positioning part and the third positioning part thereby allowing the individual front ends of the three power terminals on an externally inserted electric power plug to penetrate the three insertion holes of the socket panel, and then to be pushed forward in order to contact the first positioning part, the second positioning part and the third positioning part for conducting electric power.

3. The multidirectional socket structure according to claim 1, wherein the first positioning part is formed by two or more parallel plate bodies so as to be able to fixedly locate a plug terminal inserted from outside.

4. The multidirectional socket structure according to claim 1, wherein the second positioning part is formed by two or more parallel plate bodies so as to be able to fixedly locate a plug terminal inserted from outside.

5. The multidirectional outdoor socket structure according claim 1, wherein the third positioning part is formed by two relatively tilted plate bodies so as to be able to fixedly locate a plug terminal inserted from outside.

6. The multidirectional outdoor socket structure according to claim 1, wherein the outer case is a cubic structure and has a placement surface which is a plane.

7. The multidirectional outdoor socket structure according to claim 1, wherein the outer case further includes a USB panel which has one or more insertion holes, and the inside of the outer case has a power conversion circuit board which is electrically connected to the live wire, the neutral wire and the ground wire of the electric power line and is installed with one or more USB connectors that communicate with the insertion holes on the USB panel.

8. The multidirectional outdoor socket structure according to claim 1, further comprising an outer cladding part which envelops the outer case and facilitates a more compact assemblage of the outer case.

* * * * *